United States Patent [19]

Lewkowitz

[11] Patent Number: 4,466,220

[45] Date of Patent: Aug. 21, 1984

[54] GRILL INSERT CLIP

[76] Inventor: Bernd Lewkowitz, 306 N. Gladstone Ave., Margate, N.J. 08402

[21] Appl. No.: 277,284

[22] Filed: Jun. 25, 1981

[51] Int. Cl.[3] ..... E06B 3/30

[52] U.S. Cl. ..... 52/127.6; 52/456; 52/507; 52/712; 52/741

[58] Field of Search ..... 52/314, 315, 456, 455, 52/202, 207, 769, 772, 773, 489, 663, 507, 106, 581, 712, 127.5, 127.6, 355, 356; 24/259 R, 67.9, 255 B; 49/57, 465, 463

[56] References Cited

U.S. PATENT DOCUMENTS

| | | | |
|---|---|---|---|
| 2,743,544 | 5/1956 | Wilson | 52/663 |
| 2,916,113 | 12/1959 | Lee | 24/259 R |
| 3,546,844 | 12/1970 | Schwartz | 52/663 |
| 3,935,617 | 2/1976 | Hudson | 24/259 R |

FOREIGN PATENT DOCUMENTS

| | | | |
|---|---|---|---|
| 894043 | 4/1962 | United Kingdom | 24/259 |

*Primary Examiner*—Alfred C. Perham
*Attorney, Agent, or Firm*—Karl L. Spivak

[57] ABSTRACT

A self-locking, clear plastic clip is used to attach a decorative grillwork to a framed window insert. The clip may be factory installed between the window glass and the frame to allow for the later application of a decorative grill over the window without the need to drill holes through the grill and the insert frame. The clip is generally channel-shaped in cross sectional configuration and includes a web of length suitable to span the grill border. An attaching leg depends from one end of the web and is formed with a transverse tongue for engagement within the frame putty groove. A grill connection leg depends from the other end of the web to secure the grill in planar juxtaposition to the glass. A nib-like head extends upwardly from the web to facilitate bending of the clip for grill installation purposes.

9 Claims, 5 Drawing Figures

GRILL INSERT CLIP

BACKGROUND OF THE INVENTION

This invention relates generally to the field of building materials, and more particularly is directed to self-locking clips for use in affixing a decorative grillwork to a pre-assembled framed window.

As is well known to workers in the art, windows consisting of a single large pane of glass are generally less expensive to manufacture than a conventional divided window, which includes a plurality of smaller panes of glass retained within a plurality of mullions. For reasons of appearance, however, especially in houses of colonial design, conventional windows divided into multiple panes or lites are desired despite the increase in cost. Consequently, workers skilled in the art have sought improved constructions to continue to use the larger, comparatively inexpensive, single lites of glass without unduly affecting the appearance of the house. In one popular embodiment, prior workers have developed wooden and plastic decorative grills to simulate the appearance of a conventional multi-lite window or insert. The decorative grills were usually installed by first drilling cooperating openings in the grills and in the window frames and then using suitable fasteners, for example, screws or retractable spring loaded pins, to attach the grills to the window frames.

The prior methods of grill attachment required the use of special tools at the job site and resulted in permanently defacing both the grill and the frame at the points of attachment. Additionally, because of the high wages paid to construction workers, the need to drill openings in the grill and in the frame for grill installation at the job site frequently resulted in installation costs that far exceeded the cost of performing the same tasks in a factory. Because of this, the need remains to provide a simple, inexpensive and tool-free method for attaching a decorative grill over a window or insert.

SUMMARY OF THE INVENTION

The present invention relates generally to the field of decorative grills, and more particularly, is directed to an improved clip for easily connecting a decorative grill to the frame of a window or a door insert.

The present invention includes to an inconspicuous unitary clip which is preferably molded or otherwise fabricated of a clear, plastic material. The clip is installed between the glass and frame of a window or insert during assembly of those parts. The clip construction allows a workman or a layman to later install a decorative grill over the window without screws, or other metallic fasteners. The clip is generally channel-shaped in cross sectional configuration and is designed with a web of approximately the same length as the width of the decorative grill to which it will ultimately be applied. The web terminates endwardly in a depending attaching leg and a spaced, depending grill leg. The attaching leg includes an inwardly projecting tongue which is positioned and configured to fit within a corresponding groove such as the putty groove which is provided interiorly of the window or insert frame. The grill leg, which is spaced from and roughly parallel to the attaching leg, functions to press and retain the decorative grill against the window.

To utilize the clip to secure the decorative grill over the window, the decorative grill border is urged past the grill leg into the area defined below the web and between the grill leg and attaching leg. To do so, the grill leg must first be displaced sufficiently to allow the decorative grill border to slide into place behind it. This can be accomplished by pulling or pressing the head of the clip toward the glass to bend the attaching leg and thereby create sufficient clearance for passage of the grill border between the grill leg and the window frame. Pressure placed on the clip head causes the attaching leg to arch or bend without breaking, thereby raising the grill leg so that it clears the grill border as the grill is pressed into place. The clip is fabricated of one piece construction, and preferably is made of clear plastic or other resilient, strong material. The clip of the present invention is particularly useful to apply a decorative grill over the glass of a door insert of the general type disclosed in my previous patent, U.S. Pat. No. 3,750,358.

The clip of the present invention is particularly useful to install decorative grills over insulating windows of the "Thermopane" type. "Thermopane" type windows comprise generally two spaced panes of glass, which panes are held apart by a separating strip of suitable material disposed about the periphery of the glass. The spaced panes define an air space therebetween, which space preferably is maintained under vacuum conditions. The separating strip usually includes a sealant which also serves to preserve the vacuum. Because of the labor and parts involved, the greatest economy in home building materials can be achieved by using single pane, "Thermopane" type insulating windows. Consequently, conventional windows divided into four or six lites of glass would be prohibitively expensive if fabricated with "Thermopane" glass construction. The present invention provides a novel clear plastic clip to affix a decorative grill over a "Thermopane" type window to create the appearance of a divided, multiple pane window, without the need for usual metallic fasteners.

It is therefore an object of the present invention to provide an improved grill insert clip of the type set forth.

It is another object of the invention to provide a self-locking clip for the attachment of decorative grill to a door insert window frame in a manner that eliminates the need for screws, pins or tools.

It is another object of the invention to provide a novel self-locking clip that is easily installed into a framed window unit during manufacture of the window unit by securing a part thereof within the usual putty groove.

It is another object of the invention to provide a novel self-locking clip, which when installed in a window or insert frame permits the rapid installation of a decorative grill without requiring special tools or skilled labor.

It is another object of the invention to provide a novel self-locking clip for securing a decorative grill in a window or insert frame in a manner to permit the rapid replacement of the decorative grill without requiring tools.

It is another object of the invention to provide a self-locking clip that is inconspicuous in size and appearance and that is contructed inexpensively of durable plastic material.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
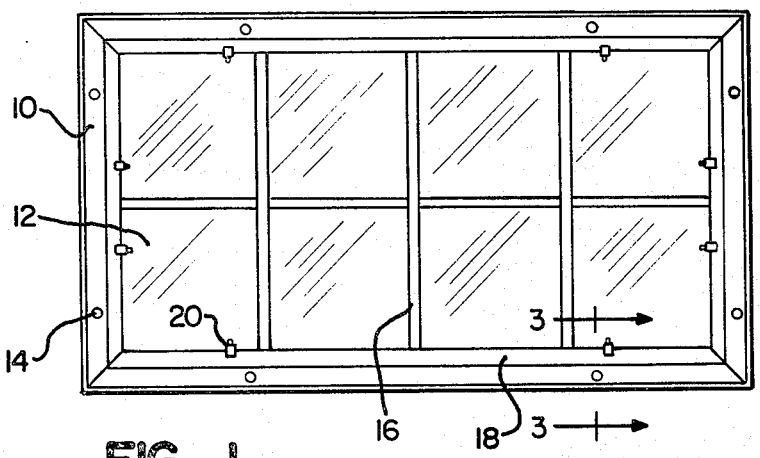
FIG. 1 is an elevational view of an insert with a decorative grill held in place by the clips of the present invention.

Although specific terms are used in the following description for the sake of clarity, these terms are intended to refer only to the particular structure of the invention selected for illustration in the drawings and are not intended to define or limit the scope of the invention.

Referring now to the drawings, there is shown in FIG. 1 an uninterrupted pane or sheet of glass 12, which may be an insulated type of glass construction. The glass 12 is retained in known manner within a two part, peripheral insert frame 10, which parts 10*a*, 10*b* are secured together conventionally with screws 14. A decorative grill 16 includes a peripheral border 18 which is sized to correspond and overfit the inner periphery of the insert frame 10. A plurality of clips 20 are provided about the grill border 18 to adequately support the grill 16. While a plurality of two clips applied at each side of the frame are illustrated, it will be appreciated that more or fewer clips 20 can be employed, depending upon the size and weight of the grill to be supported.

Figure 2:
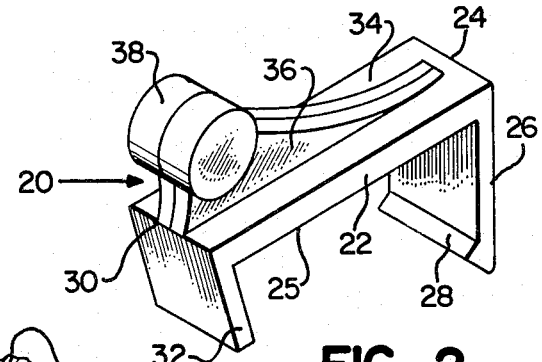
FIG. 2 is an enlarged, perspective view of a clip of the present invention.
Figure 3:
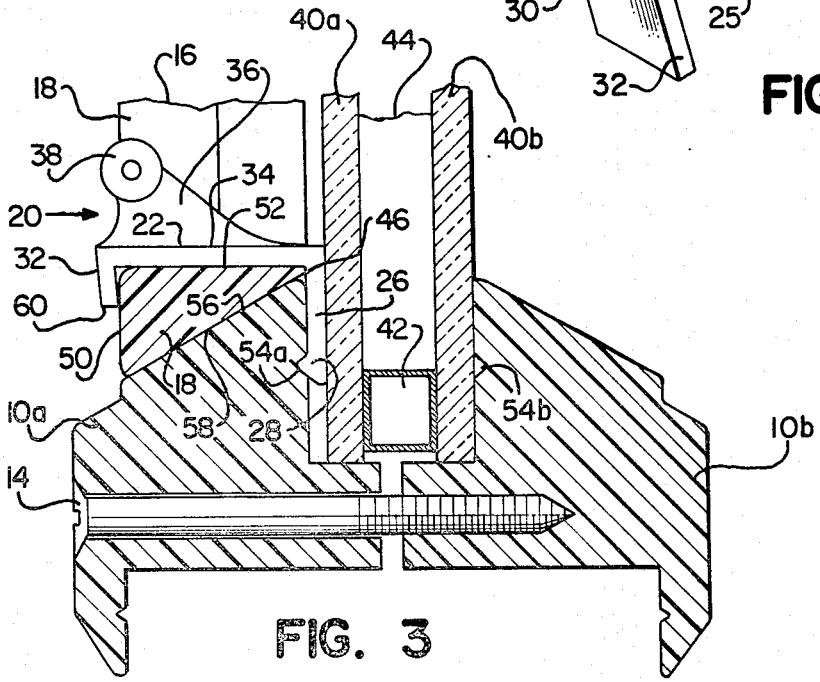
FIG. 3 is an enlarged, cross-sectional view taken along line 3—3 of FIG. 1, looking in the direction of the arrows.

Referring now to FIGS. 2 and 3, the clip 20 is illustrated in generally channel-shaped configuration having an upper web 22 which is endwardly defined respectively by the depending attaching leg 26 and the depending grill leg 32. The grill leg is shorter in length than the attaching leg 26 to facilitate installation of the grill 16 as hereinafter more fully set forth. The length of the clip web 32 should closely approximate the width of the grill border 18 to securely engage and retain the border between the clip legs 26, 32. The attaching leg 26 terminates downwardly in a transverse tongue 28, which tongue is configured and positioned to insert into and to secure within the usual putty groove 54*a*, 54*b* which is conventionally extruded or otherwise formed in the frame sections 10*a*, 10*b*. For simplicity in construction, the tongue 28 may span the width of the leg 26. The leg 26 itself should be as thin as possible consistent with adequate strength to avoid creating large gaps between the pane of glass 12 and the frame 10 along the adjacent surfaces.

Still referring to FIGS. 2 and 3, the frame member 10*a* terminates upwardly in a downwardly inclined surface 56 which receives thereon, a similarly inclined surface 58 of the grill border in overall, sliding engagement. As illustrated, the border 18 is substantially triangular in cross section whereby the inner peripheral surface 52 of the border is positioned at right angles to the plane of the glass 12. The web 22 of the clip 20 overfits the border surface 52 with the legs 26, 32 extending about the border 18. Extending at an angle of slightly less than ninety degrees from the plane of the web 22 is the grill leg 32. The grill leg 32 is fabricated of a length such that when the clip is installed over the border 18 of a decorative grill 16, the free terminus of the leg 32 will press against the outer face 50 of the border (See FIG. 3). The clip legs 26, 32 need be of no particular width. However, legs 26, 32 should be wide enough to impart adequate strength to the clip construction to permit installation and use without breaking.

A neck portion 36 to which is attached a clip head 38 extends inwardly from the inner peripheral surface 34 of the web 22 to provide a convenient grasping area for manipulating the clip 20 when in use. The head 38 and neck 36 need not be precisely fabricated in the configuration shown in the drawing inasmuch as any variation which can provide a similar function will suffice. The main function of the head 38 is to serve as a graspable extension of the clip 20 which can be used to raise the grill leg 32 relative to the frame by bending the attaching leg 26 to provide clearance for the grill border 18 during installation. By pressing the head 38 of the installed clip 20 towards the glass 12, the clip web 22, the attaching leg 26 and the junction 24 therebetween will flex and bend. As the angle between the attaching leg 26 and web 22 is increased, the grill leg 32 will be increasingly raised until it clears the top surface 52 of the grill border 18 to allow the grill 16 to be pressed against the glass 12 in the desired position. Upon releasing the pressure on the clip head 38, the natural memory of the clip material will immediately return the clip to its original, unbended condition whereby the grill leg 32 will overfit the border vertical surface 50 to thereby retain the grill 16 in the desired position over the window 12.

Figure 4:
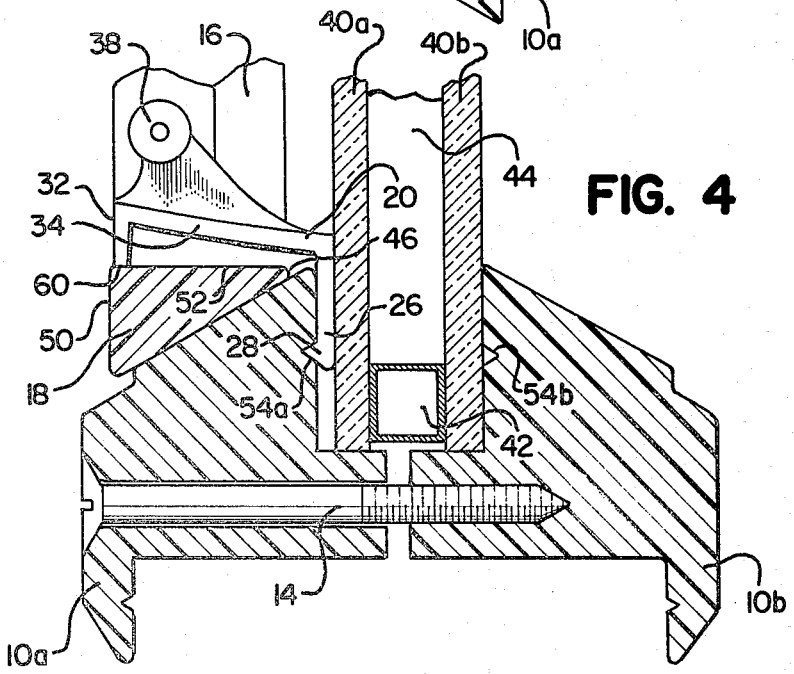
FIG. 4 is a cross sectional view similar to FIG. 3 showing the position of a grill border prior to locking engagement under the clip.

As best seen in FIGS. 3 and 4, the installation and retention of the grill 16 in association with a window glass can be described. In a conventional insulated glass insert, two sheets or panes of glass 40*a*, 40*b* are placed in parallel alignment, with a conventional spacer 42 extending peripherally around the circumference of the window panes. The space 44 defined between the glass panes 40*a*, 40*b* is evacuated in known manner and the glass construction is peripherally sealed to prevent loss of the vacuum. The insert frame 10 in which the insulated glass construction is seated comprises two essentially similar frame halves 10*a* and 10*b*. In FIG. 3, the interaction of the insert frame 10, the grill border 18 and the clip 20 when completely assembled is shown. The attaching leg 26 is disposed between one of the panes of glass 40*a* and the frame half 10*a*. The tongue 28 on the free end of the leg 26 positions within the frame putty groove 54*a* and serves to keep the leg in place by supporting the clip 20 at a predetermined position, thereby creating a locking space between the web 22 and frame surface 56 for the grill border 18 to rest and be retained therewithin.

The grill leg 32 is disposed from the plane of the web 22 at an angle slightly less than ninety degrees to exert pressure on the grill border outer face 50 thereby urging the grill 16 against the window pane 40*a*. The interfacing inclined surfaces 56, 58 of the grill border 18 and the window frame 10*a* function, in conjunction with the clip 20, to maintain the grill 16 in close association with the window 12.

Figure 5:
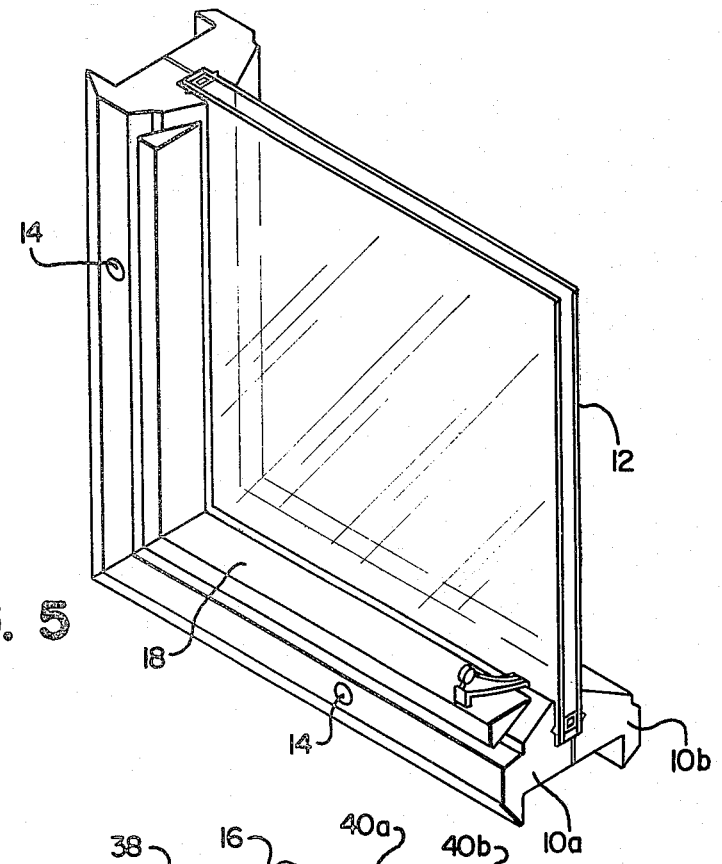
FIG. 5 is a partial, perspective view of a window showing the position of the grill of FIG. 4.

FIGS. 4 and 5 illustrate one stage of the grill installation process. The attaching leg 26 is installed between the glass 40*a* and the frame 10*a* during manufacture. The clip is positioned with the tongue 28 disposed in the putty groove 54*a* after which the screw 14 can be tightened to keep window panes 40*a*, 40*b*, the frame members 10*a*, 10*b* and the clip 20 in fixed arrangement. To install a decorative grill 16, the border 18 is first generally aligned over the window frame 10*a*. Pressure is then applied on the clip head 38 to push it towards the glass 40*a* until the grill leg 32 clears the inner surface 52 of the grill border 18 as the grill 16 is pushed toward the window 40*a*. The clip 20 bends sufficiently to allow the border 18 to slide under terminus 60 of the grill leg 32 as the grill is being pushed into close association with the glass 40*a*. In this position, the clip is bent to provide an angularity of greater than ninety degrees between the clip web 22 and the attaching leg 26. To complete installation, the grill need only be pushed until its inner surface 46 is brought into contact with the junction 24 between the web 22 and the attaching leg 26. At this point, the grill border outer face 50 will clear the grill leg 32 and allow the attaching leg 26 to snap back to its ninety degree orientation, thereby locking grill 16 in place over the insert glass.

To remove the decorative grill 16, the installation steps can be reversed. The clip web 22 is raised by exerting pressure on the head 38 toward the window glass until the grill leg 32 clears the grill border inner surface 52. With the clips in this position, there is no force remaining to hold the grill 16 against the glass 40*a*, thus permitting its easy removal.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In a construction to attach a decorative grill having a peripheral border to a framed window insert of the type including at least one pane of glass and a peripheral frame overfitting a peripheral portion of the pane of glass to retain the glass the improvement comprising a clip having a generally channel-shaped, plastic body of configuration to overfit the peripheral border part of the grill, the body comprising a web having first and second ends, an attaching leg extending at right angles from the first end of the web and being adapted to insert between the frame and the peripheral portion of the glass to secure the body to the frame, the attaching leg directly contacting the frame and not contacting the grill, and a grill leg extending from the second end of the web, the grill leg being in contact with the peripheral border part of the grill to attach the grill to the frame, the web, the attaching leg and the grill leg defining a body having a closed top and an open bottom; and means connected to the body to temporarily move the clip web relative to the attaching leg to vary the angle between the web and the attaching leg sufficiently to permit a portion of the grill border to position between the frame and the grill leg for attachment and removal of the decorative grill to and from the insert.

2. The clip of claim 1 wherein one end of the attaching leg is equipped with a protruding tongue, the tongue being adapted to seat within a cooperating groove provided in the said frame, the tongue extending in a direction facing the grill leg.

3. The clip of claim 2 wherein the tongue is spaced from the web a distance that is greater than the length of the grill leg and wherein the grill leg defines an angle with the web that is less than ninety degrees.

4. The clip of claim 1 wherein the means to move the clip comprises an integral head which extends from the web in a direction opposite to the first and second leg means a distance sufficient to permit grasping for clip bending purposes.

5. The method for applying a decorative grill over a framed glass insert using a clip of the type having a web, a first leg extending from one end of the web, a second leg extending from the other end of the web and a head projecting from the web comprising:

inserting a portion of the first leg between the glass and the frame;

aligning the decorative grill over the glass within the frame;

creating an opening between the second leg and the frame;

pressing a part of the grill through the opening and contacting the glass with part of the grill; and reducing the size of the opening and contacting the grill with the second leg to retain the grill over the glass.

6. The method of claim 5 wherein the creating of the opening includes bending the clip.

7. The method of claim 6 wherein bending the clip includes pushing the clip head toward the glass.

8. The method of claim 6 wherein the reducing the size of the opening includes unbending the clip.

9. The method of claim 5 wherein the frame includes an internal groove and the first leg includes a projecting tongue and the further step of locking the tongue within the groove while inserting the first leg between the glass and the frame.

* * * * *